United States Patent [19]

Sugiura

[11] Patent Number: 4,712,921

[45] Date of Patent: Dec. 15, 1987

[54] MIXER FOR CONTINUOUSLY MIXING FLUIDS

[76] Inventor: Hikoroku Sugiura, 1-1569-1 Minami, Kaijin-cho, Funabashi-shi, Chiba-ken, Japan

[21] Appl. No.: 924,343

[22] Filed: Oct. 24, 1986

[51] Int. Cl.[4] ..... B01F 5/04

[52] U.S. Cl. ..... 366/151; 366/336; 366/338

[58] Field of Search ..... 366/336, 337, 340, 150, 366/151, 132, 142, 152, 160, 161, 163, 338

[56] References Cited

U.S. PATENT DOCUMENTS 4,027,859 6/1977 Stone ..... 366/151
4,416,610 11/1983 Gallagher ..... 366/150
4,432,651 2/1984 McLeod ..... 366/150
4,468,127 8/1984 Agosta ..... 366/150

*Primary Examiner*—Robert W. Jenkins
*Attorney, Agent, or Firm*—Wenderoth, Lind & Ponack

[57] ABSTRACT

There is provided a mixer for continuously mixing fluids together.

The mixer comprises a hollow cylindrical body having an enlarged diameter central portion and inlet and outlet ports at the opposite ends of the body; an impinging disc vertically disposed in the enlarged diameter central portion within the body and having a peripheral projection which defines an annular clearance between the outer surface of the projection and the inner surface of the enlarged diameter central portion of the body.

3 Claims, 4 Drawing Figures

MIXER FOR CONTINUOUSLY MIXING FLUIDS

BACKGROUND OF THE INVENTION

This invention relates to improvements in and relating to mixers for continuously mixing fluids and, more particularly, to improvements in and relating to mixers for continuously mixing fluids which are adapted to be provided in the material supply pipe extending from a slurry tank associated with a paper making machine in the paper pulp industry and which eliminates ununiform concentration distribution of materials being conducted through the material supply pipe.

In the paper pulp industry, in order to stabilize and rationalize the operation on a paper making machine, it is strongly desired that the concentration of pulp is controlled with a high precision. As well known in the paper pulp industry, the pulp concentratin control referred to hereinabove is performed by infusing dilution water into a flow of slurry (the term "slurry" employed herein means gruel state pulp) flowing in a flow path, determining the concentration of the diluted slurry downstream of the dilution water infusion point and regulating the infusion amount of the water based on the determination result. Thus, although the mixing of slurry and dilution water may be satisfactorily attained in the zone of the flow path between the dilution water infusion and concentration determination points of the path, it is quite important that the pulp concentration control be performed with a higher precision. Therefore, in order to improve control precision of pulp concentration, it has been proposed that various mixers are provided in the slurry flow path upstream of the concentration determination point and the arrangement has provided appreciable effects.

As the prior art mixers, there have been known the agitation type mixer in which the rotary shaft is provided with the agitation wings or pawls and the static type mixer in which the screw plate is disposed within the body which is connected to a midway of a piping. The former agitation type mixer requires a substantial operation power and is also vulnerable to damage subjected to physically external force and thus, of late, the static type mixer has been widely employed.

The prior art static type mixer is schematically shown in FIG. 4 of the accompanying drawings. In the static type mixer employing the screw plate 24, flows of materials are mixed together only through energy exchange between portion of energy in the flow directions of materials flows flowing along the screw plate 24 and the screw plate 24 and thus, in order to provide a desired mixing effect, it is necessary to reduce the spiral pitch of the screw plate 24 to thereby increase the number of twists. Otherwise, since portions of material flows having different concentrations merely replace their places, a desired mixing effect cannot be obtained. As a result, the static type mixer is troublesome in fabrication and expensive. The static type mixers have a substantial length (the practical mixers now in operation comprise 5 to 8 screw plates, each having one twist, arranged in series and have the full length from 3–5 m) and thus, such static mixers are subjected to limitation with respect to their installation location. And the prior art static mixers have the drawback that pressure loss in the mixers is substantial.

SUMMARY OF THE INVENTION

Therefore, the present invention has its object to provide a mixer for continuously mixing fluids which can effectively eliminate the drawbacks inherent in the prior art mixers referred to hereinabove, which is simpler in construction and small in size and which has reduced pressure loss.

In order to attain the object, according to one aspect of the present invention, there is provided a mixer for continuously mixing fluids which comprises a hollow cylindrical body including an enlarged diameter central portion, an inlet port provided at one end of said body and tapering towards said central portion and an outlet port provided at the other end of said body; and an impinging disc disposed vertically within said enlarged diameter central portion of the body and having the diameter greater than the smallest diameter of said inlet port and smaller than the diameter of said enlarged diameter central portion, said impinging disc being provided at the periphery with a projection extending towards said inlet port so as to define an annular clearance between the inner surface of said enlarged diameter central portion and the periphery of said disc.

The mixer of the present invention is provided in a midway of the flow path of fluids so that flows of fluids being guided through the inlet port towards the outlet port are converged by the tapered inlet port 11 as shown by the arrow $P_1$ in FIG. 2. The fluids then impinge against the impinging disc 20 at the central area thereof as shown by the arrow $P_2$ in FIG. 2 and displace radially outwardly along the impinging disc 20. Thus, as experienced in the conventional static type mixer referred to hereinabove, the fluids are agitated as they impinge against the impinging disc 20 and displace along the disc.

However, according to the present invention, different from the conventional static type mixer, when the fluids displace to the periphery of the impinging disc, the fluids impinge against the peripheral projection 21 or 21*a* to become whirling flows as shown by the arrow $P_3$ in FIG. 2. And portions of the fluids pass through the annular clearance defined between the periphery of the impinging disc 20 and the inner surface of the enlarged diameter central portion 12 of the body 10 to the outlet port 13 as shown by the arrow $P_4$ in FIG. 2 whereby the fluids in the arrow direction $P_3$ and the fluids in the arrow direction $P_4$ flow in convection relationship to improve the mixing efficiency.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

PREFERRED EMBODIMENT OF THE INVENTION

Figure 1:
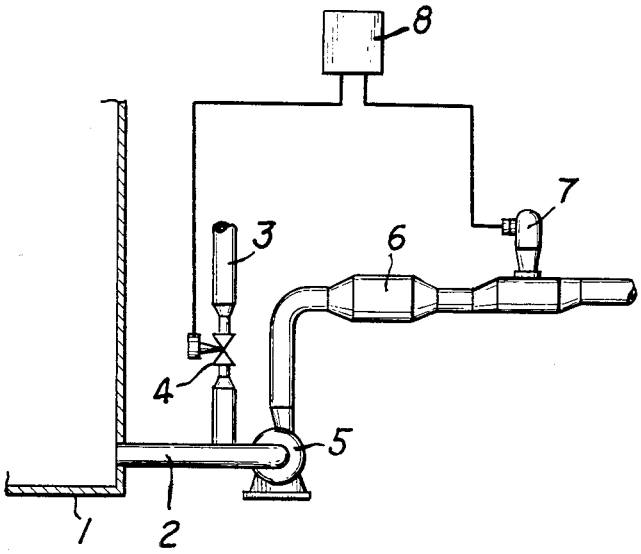
FIG. 1 is a front elevational schematic view of a pulp concentration control apparatus in which the mixer for continuously mixing fluids according to the present invention is incorporated.
Figure 2:
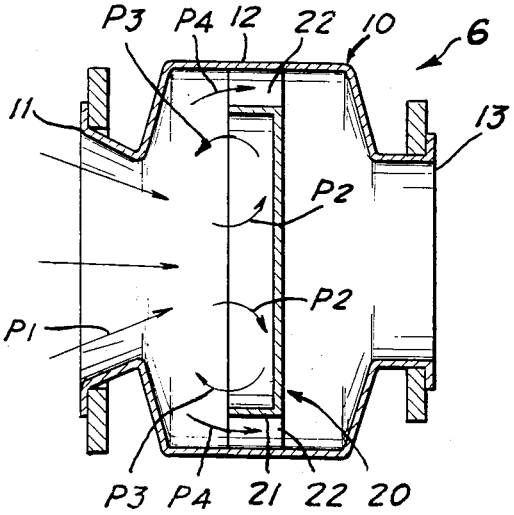
FIG. 2 is a vertically sectional view on an enlarged scale of the mixer according to the present invention.
Figure 3:
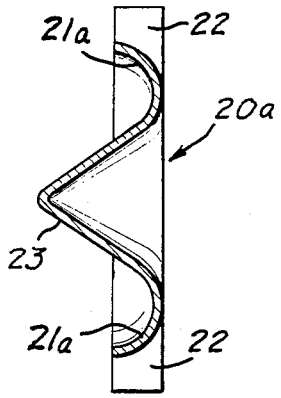
FIG. 3 is a vertically sectional view of a modification of the impinging disc shown in FIG. 2.

The present invention will be now described referring to the accompanying drawings and, more particularly, to FIGS. 1 through 3 in which the preferred embodiment of the mixer according to the present invention is shown.

In FIG. 1, reference numeral 1 denotes a slurry tank. A material supply pipe 2 is connected at one end to the slurry tank 1 and at the other end to a suitable device such as the dispensing tank or the like of a paper-making machine (not shown).

A pump 5 and the mixer 6 according to the present invention are provided in spaced positions in the material supply pipe 2 between the opposite end thereof with the mixer 6 disposed downstream of the pump 5. A dilution water injection pipe 3 is connected to the material supply pipe 2 upstream of the pump 5 and a concentration determination device 7 is connected to the material supply pipe 2 downstream of the mixer 6, respectively. The determination result or value from the concentration determination device 7 is input to a control board 8 which in turn processes the input signal and controls the opening of the control valve 4 in the dilution water injection pipe 3 based on the input signal.

As more clearly shown in FIG. 2, the mixer 6 of the present invention comprises a hollow cylindrical body 10 having an enlarged diameter central portion 12, an inlet port 11 provided at one end of the body and tapering downstream or towards the central portion 12 and an outlet port 13 of uniform diameter provided at the other end of the body. Although not shown, the smallest diameter inner end of the inlet port 11 preferably has a diameter equal to or larger than the diameter of the material supply pipe 2 so that whirling flows of fluids may be produced to a maximum extent on an impinging disc 20 of which description will be made hereinafter. For the purpose, the portion of the material supply pipe 2 where the pipe is connected to the inlet port 11 is preferably enlarged. The impinging disc 20 is vertically disposed within the enlarged diameter central portion 12 of the body 10 and has the diameter larger than the diameter of the smallest diameter inner end of the inlet port 11 and smaller than the inner diameter of the central. The impinging disc 20 has an annular peripheral projection 21 extending towards the inlet port 11 and thus, the disc assumes a cup shape. The impinging disc 20 is so positioned within the enlarged diameter central portion 12 that an annular space is left between the inner surface of the central portion 12 and the outer surface of the projection 21. In order to fixedly position the impinging disc 20 within the enlarged diameter central portion 12 of the body 10, a plurality of circumferentially spaced radial stays 22, 22, 22, . . . are provided on the outer periphery of the annular projection 21 and the free ends of the stays 22 are suitably secured to the inner surface of the enlarged diameter central portion 12 of the body 10. Although not shown, one end of the stay 22 may project towards the outlet port 13 so that the stay serves as a flow regulation means. The total cross-sectional area of the annular space defined between the outer surfaces of the projection 21 on the impinging disc 20 and the inner surface of the enlarged diameter central portion 12 of the body 10 is designed greater than one third of the cross-sectional area of the material supply pipe 2 so that occurrence of clogging in the annular space is prevented.

FIG. 3 shows a modification of the impinging disc 20 as shown in FIG. 2. The central area of the modified impinging disc 20*a* projects in a conical shape towards the inlet port 11 as shown by reference numeral 23. The peripheral edge 21*a* of the impinging disc 20 bulges in a semi-circular shape towards the outlet port 13.

Figure 4:
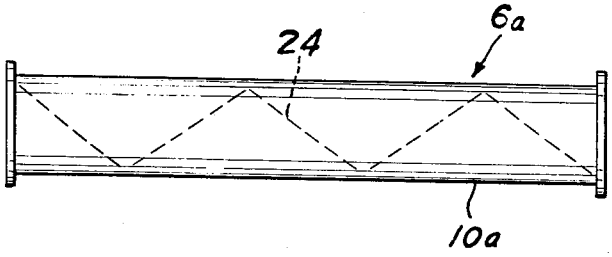
FIG. 4 is a front elevational schematic view of a conventional static type mixer.

As mentioned hereinabove, in the mixer for continuously mixing fluids according to the present invention, mixing of fluids is effected by energy exchange between fluids which takes place as they impinge against the impinging disc 20 or 20*a* and its projection 21 or projections 21*a* and 23 and also by that of wirling flows of the fluids which are produced as the fluids flow in convection in the region of the impinging disc 20 or 20*a*. The whole energy thus produced is consumed for the mixing of the fluids. Thus, the mixer of the present invention is more effective than the conventional static type mixer 6*a* shown in FIG. 4 and described hereinabove in which most of fluid energy is consumed on the screw plate 24.

In the mixer according to the present invention, since the inlet port 11 tapers downstream or towards the impinging disc 20 and enlarges its diameter upstream or towards the material supply pipe 2, the fluids flowing into the body 10 via the inlet port 11 impinge against the impinging disc 20 at the central area thereof and positively produce swirling flows of the fluids upstream of the peripheral projection of the impinging disc. The production of the swirling fluid flows enhances the mixing efficiency of the mixer.

Furthermore, since the mixer of the invention is simpler in construction and smaller in size, the mixer occupies a relatively smaller area of space for the installation thereof and attains saving in operation power thanks to the enhanced efficiency.

The advantages of the present invention, as well as certain changes and modifications of the disclosed embodiment thereof, will be readily apparent to those skilled in the art. It is the applicant's intention to cover by his claims all those changes and modifications which would be made to the embodiment of the invention herein chosen for the purpose of the disclosure without departing from the spirit and scope of the invention. Protection by Letters Patent of this invention in all its aspects as the same are set forth in the appended claims is sought to the broadest extent that the prior art allows.

What is claimed is:

1. A mixer for continuously mixing fluids adapted to be employed in conjunction with a paper-making line comprising a slurry tank, a material supply pipe extending from said slurry tank and including a pump, a dilution water injecting pipe connected to said supply pipe upstream of said pump, a concentration determination device connected to said supply pipe downstream of said pump and a control board operatively connected to said concentration determination device, characterized in that said mixer is mounted in said material supply pipe between said pump and said concentration determination device and comprises a hollow cylindrical body including an enlarged diameter central portion, an inwardly tapering inlet port provided at one end of said body and connected to said supply pipe and an outlet port of uniform diameter provided at the other end of said body; and an impinging disc disposed vertically within said enlarged diameter central portion and having the diameter greater than the minimum diameter of said inlet port and smaller than the diameter of said enlarged diameter central portion of the body, said impinging disc having a projection at the periphery of the disc extending towards said inlet port so as to define an annular clearance between the inner surface of said enlarged diameter central portion and the periphery of said disc.

2. The mixer as set forth in claim 1, in which said projection at the periphery of said impinging disc extends horizontally towards said inlet port.

3. The mixer as set forth in claim 1, in which said impinging disc further includes a conical projection at the central area thereof and said peripheral projection has a semi-circular shape.

* * * * *